US011885490B2

(12) United States Patent
Stockton

(10) Patent No.: US 11,885,490 B2
(45) Date of Patent: Jan. 30, 2024

(54) BURNER ASSEMBLIES AND METHODS

(71) Applicant: Hydrogen Technologies LLC, Newtown, PA (US)

(72) Inventor: Edward Joseph Stockton, Stockton, CA (US)

(73) Assignee: Hydrogen Technologies LLC, Newtown, PA (US)

( * ) Notice: Subject to any disclaimer, the term of this patent is extended or adjusted under 35 U.S.C. 154(b) by 0 days.

(21) Appl. No.: 17/834,534

(22) Filed: Jun. 7, 2022

(65) Prior Publication Data

US 2022/0390101 A1 Dec. 8, 2022

Related U.S. Application Data

(60) Provisional application No. 63/202,364, filed on Jun. 8, 2021.

(51) Int. Cl.

| | |
|---|---|
| ***F23N 1/00*** | (2006.01) |
| ***F23D 14/32*** | (2006.01) |
| ***F23D 14/22*** | (2006.01) |
| ***F23D 14/70*** | (2006.01) |

(52) U.S. Cl.

CPC ..... *F23D 14/32* (2013.01); *F23D 14/22* (2013.01); *F23D 14/70* (2013.01); *F23C 2900/9901* (2013.01)

(58) Field of Classification Search

CPC ..... F23D 14/32; F23D 14/22; F23D 14/70; F23C 2900/9901

USPC ..... 431/6

See application file for complete search history.

(56) References Cited

U.S. PATENT DOCUMENTS

| | | | | | |
|---|---|---|---|---|---|
| 1,456,250 | A | * | 5/1923 | Munzner | F23D 14/48 48/180.1 |
| 2,483,975 | A | * | 10/1949 | Hoogendam | F23D 11/04 239/222 |
| 2,667,033 | A | * | 1/1954 | Ashwood | F23R 3/04 60/751 |
| 2,890,166 | A | | 6/1959 | Heinze | |

(Continued)

FOREIGN PATENT DOCUMENTS

| | | |
|---|---|---|
| CN | 108871651 | 11/2018 |
| EP | 0980106 | 2/2000 |

(Continued)

OTHER PUBLICATIONS

US, U.S. Appl. No. 17/839967, filed Jun. 14, 2022, Reactor Safety Devices and Methods.

(Continued)

*Primary Examiner* — Avinash A Savani

(74) *Attorney, Agent, or Firm* — Knobbe, Martens, Olson & Bear, LLP

(57) ABSTRACT

A burner includes a main flange, an oxidant inlet coupled to the main flange, a combustion fuel inlet coupled to the main flange, a nozzle pipe coupled to the main flange, an outer pipe coupled to the main flange, and a diffuser coupled to the nozzle pipe and the outer pipe. The nozzle pipe has an inner volume in fluid communication with the oxidant inlet. The outer pipe is around the nozzle pipe. An annular volume is at least partially defined by the main flange, the nozzle pipe, the outer pipe, and the diffuser. The annular volume is in fluid communication with the combustion fuel inlet. The diffuser may be flat.

25 Claims, 5 Drawing Sheets

(56) References Cited

U.S. PATENT DOCUMENTS

| | | | | |
|---|---|---|---|---|
| 3,245,457 | A * | 4/1966 | Smith | F23Q 3/008 431/11 |
| 4,063,414 | A | 12/1977 | Sata et al. | |
| 4,304,095 | A | 12/1981 | Rasanen | |
| 4,320,874 | A | 3/1982 | Leinberger et al. | |
| 4,644,905 | A | 2/1987 | Vierling | |
| 4,841,731 | A | 6/1989 | Tindell | |
| 4,971,550 | A * | 11/1990 | Schingnitz | F23D 14/22 431/258 |
| 5,615,833 | A | 4/1997 | Robillard et al. | |
| 5,620,316 | A | 4/1997 | Duboudin et al. | |
| 5,953,900 | A | 9/1999 | Bannister et al. | |
| 5,956,937 | A | 9/1999 | Beichel | |
| 5,957,678 | A | 9/1999 | Endoh et al. | |
| 5,975,569 | A * | 11/1999 | Starozhitsky | B60R 21/2644 280/741 |
| 6,032,467 | A | 3/2000 | Oshita et al. | |
| 6,258,221 | B1 | 7/2001 | Lin et al. | |
| 6,523,349 | B2 | 2/2003 | Viteri | |
| 6,945,029 | B2 | 9/2005 | Viteri | |
| 8,479,519 | B2 * | 7/2013 | Chen | F23D 14/78 60/742 |
| 8,701,421 | B2 | 4/2014 | Glasgow et al. | |
| 2003/0131582 | A1 | 7/2003 | Anderson et al. | |
| 2004/0050070 | A1 * | 3/2004 | Sprouse | F23K 5/002 60/776 |
| 2005/0048430 | A1 * | 3/2005 | Steiner | F23D 23/00 431/278 |
| 2007/0037025 | A1 | 2/2007 | Venkataraman et al. | |
| 2007/0042306 | A1 * | 2/2007 | Bacon | F23Q 11/00 431/278 |
| 2007/0224563 | A1 | 9/2007 | Glasgow et al. | |
| 2008/0176117 | A1 | 7/2008 | Koike | |
| 2009/0193807 | A1 | 8/2009 | Glasgow et al. | |
| 2012/0070788 | A1 | 3/2012 | Noh et al. | |
| 2014/0234787 | A1 * | 8/2014 | De La Sovera | F23C 1/08 431/12 |
| 2014/0319843 | A1 * | 10/2014 | Perry | F02C 3/00 60/726 |
| 2015/0033845 | A1 | 2/2015 | Cacciola et al. | |
| 2016/0131361 | A1 * | 5/2016 | Skachkov | F23D 14/20 431/5 |
| 2017/0314778 | A1 * | 11/2017 | Büchner | F23C 99/003 |
| 2018/0023807 | A1 * | 1/2018 | Karkow | F23D 14/26 431/8 |
| 2018/0058688 | A1 | 3/2018 | Manville | |
| 2018/0156451 | A1 | 6/2018 | Hirata et al. | |
| 2020/0224872 | A1 | 7/2020 | Mu et al. | |
| 2022/0404018 | A1 | 12/2022 | Stockton | |

FOREIGN PATENT DOCUMENTS

| | | |
|---|---|---|
| EP | 1085261 A1 | 3/2001 |
| FR | 637649 | 5/1928 |
| GB | 191228753 | 12/1913 |
| GB | 160517 | 3/1921 |
| GB | 2607736 | 12/2022 |
| GB | 2608011 | 12/2022 |
| JP | 2016-192269 | 11/2016 |
| WO | WO 2009/035334 | 3/2009 |
| WO | WO 2022/261057 | 12/2022 |
| WO | WO 2022/266134 | 12/2022 |

OTHER PUBLICATIONS

PCT Search Report and Written Opinion for PCT/US22/32449 dated Oct. 28, 2022, 16 pages.

Erickson, Paul A., "Analysis of H2—O2 Combustion under various pressures in the SOG Dynamic combustion chamber", Final report to SOG R&D; The Regents of the University of California, Davis; Reporting period from Mar. 1, 2007-May 30, 2008, 42 pages.

"Tracts Written by the Honourable Robert Boyle, Containing New Experiments, Touching the Relation Between Flame and Air. And About Explosions . . . " New York: McGraw Hill, 1952, http://web.lemoyne.edu/~giunta/boyle.html, 4 pages downloaded and printed from the World Wide Web on or about Dec. 30, 2005.

"Water-tube Boiler," Wikipedia, http://en.wikipedia.org/wiki/Water-tube_boiler, 2 pages downloaded and printed from the World Wide Web on or about Mar. 20, 2006.

"Steam Engine," Wikipedia, http://en.wikipedia.org/wiki/Steam_engine, 10 pages downloaded and printed from the World Wide Web on or about Dec. 29, 2005.

"Combustion," The Chemistry of Combustion in Plain English, http://energyconcepts.tripod.com/energyconcepts/combustionfluegasses.htm, 13 pages downloaded and printed from the World Wide Web on or about Dec. 14, 2005.

Rhodes, Dr. W.A., "Common Duct Electrolytic Oxyhydrogen," Superhot Atomic Oxy-Hydrogen Flame, KeelyNet Mar. 18, 2000, http://www.keelynet.com/energy/oxyhyd2.htm, 8 pages downloaded from the World Wide Web on or about Dec. 14, 2005.

Kumakura, T.; Hiraoka, K.; Ikame, M.; Kan, S. & Morishita, T. (1992), "Combustion Characteristics of Stoichiometric Hydrogen and Oxygen Mixture in Water," Int. J. Hydrogen Energy (vol. 17, No. 11, pp. 887-894).

Sternfeld, H.J. & Heinrich, P. (1989), "A Demonstration Plant for the Hydrogen/Oxygen Spinning Reserve," Int. J. Hydrogen Energy (vol. 14, No. 10, pp. 703-716).

Chapman, A. (1996) "England's Leonardo: Robert Hooke (1635-1703) and the Art of Experiment in Restoration England," Proceedings of the Royal Institute of Great Britain 67, 1996, pp. 239-275, http://www/rod.beavon.clara.net/leonardo.htm, 27 pages downloaded from the World Wide Web on or about Dec. 30, 2005.

Cecil, Rev. W. (1820) "On the Application of Hydrogen Gas to Produce a Moving Power in Machinery; with a Description of an Engine which is moved by the Pressure of the Atmosphere upon a Vacuum Caused by Explosions of Hydrogen Gas and Atmospheric Air," Fellow of Magdalen College and of the Cambridge Philosophical Society.

"The Hydrogen Engine," University of Cambridge Department of Engineering, http://www.eng.cam.ac.uk/DesignOffice/projects/cecil/engine.html, 2 pages downloaded and printed from the World Wide Web on or about Dec. 21, 2005.

Hydrogen Fuel Cell Engines and Related Technologies (Dec. 2001), "Module 3: Hydrogen Use in Internal Combustion Engines," College of the Desert.

Sugisita H.; Mori, H. & Uematsu, K. (1998), "A Study of Thermodynamic Cycle and System Configurations of Hydrogen Combustion Turbines," Int. J. Hydrogen Energy (vol. 23, No. 8, pp. 705-712).

Sugishita, H.; Mori, H. & Uematsu, K. (1998) "A Study of Advanced Hydrogen/Oxygen Combustion Turbines," Hydrogen Power: Theoretical and Engineering Solution, Kluwer Academic Publishers (pp. 511-514).

Taniguchi, H.; Tezuka, J.; Iwatta, M. & Arai, N. (2001), "Major Auxiliary Equipment Needs for the World Energy Network Project," Energy Conversion and Management (pp. 1831-1837).

* cited by examiner

FIG. 1Cii

FIG. 1Ciii

FIG. 1Civ

BURNER ASSEMBLIES AND METHODS

INCORPORATION BY REFERENCE

The present application claims the benefit of U.S. Provisional Application No. 63/202,364, filed Jun. 8, 2021, titled BURNER ASSEMBLIES AND METHODS, the entire contents of which are incorporated by reference herein and made a part of this specification for all purposes.

BACKGROUND

Field

The present disclosure relates generally to burner assemblies and methods (e.g., for combustion of hydrogen and oxygen), and, more particularly, to burner assemblies and methods for use in combustion chambers (e.g., boilers).

Description of the Related Art

As the world's population grows and modernizes, the demand for electricity also grows. One option is to build more traditional electric power plants. However, power plants that produce electricity typically also produce high levels of pollution. For example, coal, oil, and natural gas plants burn hydrocarbons to produce energy, but also produce large quantities of greenhouse gases such as carbon monoxide, carbon dioxide, and nitrogen oxides as well as mercury, polynuclear aromatic hydrocarbons (PNAs), which are often mutagenic as teratogens and carcinogens, along with and sulfur oxides. Additionally, the fuels used in traditional power plants are non-renewable resources that may run out within this century.

An alternative to traditional power plants is nuclear power. Fission reactors generate heat that results from the nuclear fission of uranium and use that heat to produce steam. The steam is fed into steam turbine that converts the energy stored in the steam into electricity. While nuclear power plants do not produce greenhouse gases, they do produce nuclear waste, which is toxic and takes millennia to degrade. Furthermore, history has shown that accidents at nuclear plants can have disastrous consequences. As such, nuclear plants are preferably located in isolated areas. However, large urban areas usually do not have the space available for such remote energy sources, and transmission of power typically results in large losses.

Other alternatives to traditional power plants that do not produce greenhouse gases use solar, wind, and wave energy to produce electricity. In addition to still being in the early stages of development, a major drawback to these energy sources is that they lack certainty. For example, when the sun is not shining, the wind is not blowing, or the water is not moving, these sources will not produce electricity. Thus, a need remains for a power source that does not produce greenhouse gases, is not disastrously dangerous, is renewable, and has a high degree of certainty.

SUMMARY

Dynamic combustion chambers for the reaction of pure hydrogen and pure oxygen, for example as disclosed in U.S. Pat. No. 7,546,732, which is hereby incorporated by reference in its entirety for all purposes, can solve many of the challenges presented by traditional power plants. For example, the combustion produces only pure water and heat. The pure water can be recycled to be split into pure hydrogen and oxygen (e.g., using a renewable resource to provide energy for electrolysis) and the heat (e.g., in the form of steam) can be used to directly or indirectly drive turbines to produce electricity.

Burner designs that are too complex can needlessly increase costs. Current burners suffer from various limitations, including flashback, turbulent flame patterns, hydrogen oxidation at adiabatic conditions, etc. Careful burner design may improve efficiency of combustion. Proper nozzle design is a component of an efficient burner design. Burner efficiency scales with flow rates, which are directly dependent on nozzle designs. The burner and/or nozzle designs disclosed herein reduce (e.g., mitigate, eliminate) limitations of current burners by incorporating molecular sizes, mass ratios of hydrogen and oxygen, and/or physical characteristics of trajectories of objects in motion.

Molecular mass relative to the oxidants and reactants can be related to design of the burner, and specifically distribution of apertures and delivery pressure. Introducing materials with greater molecular mass into a central zone of the burner can allow efficient burner design.

Mass ratios of reactants to oxidants can play a role in burner design. The molecular weight of a fuel presented within a combustion chamber along with the reactants' affinities for each other at different states can allow calculation of chemical affinities of reactions to form species of interest from the basis species.

An example of a burner that can improve the combustion efficiency includes an inner route for providing oxygen to an igniter and an outer route for providing hydrogen to the igniter. The hydrogen and oxygen come out of a diffuser having holes for oxygen surrounded by holes for hydrogen. Due to the relative molecular weights (oxygen being about 16 times as heavy as hydrogen), the hydrogen collapses towards the oxygen, for example due to differential mass effects, which mixes the hydrogen and the oxygen for enhanced combustion.

In some embodiments, a burner comprises a main flange, an oxidant inlet coupled to the main flange, a combustion fuel inlet coupled to the main flange, a nozzle pipe coupled to the main flange, an outer pipe coupled to the main flange, and a diffuser coupled to the nozzle pipe and the outer pipe. The nozzle pipe has an inner volume in fluid communication with the oxidant inlet. The nozzle pipe includes a first cylindrical section having a first diameter. The first section is proximate the oxidant inlet. The nozzle pipe includes a second cylindrical section having a second diameter larger than the first diameter. The nozzle pipe includes a third frustoconical section between the first cylindrical section and the second cylindrical section. The third frustoconical section expands from the first diameter to the second diameter. The outer pipe is around the nozzle pipe. An annular volume is at least partially defined by the main flange, the nozzle pipe, the outer pipe, and the diffuser, the annular volume in fluid communication with the combustion fuel inlet. The diffuser is flat. The diffuser includes a first plurality of apertures in fluid communication with the inner volume of the nozzle pipe and a second plurality of apertures in fluid communication with the annular volume of the nozzle pipe.

In some embodiments, a burner comprises a main flange, an oxidant inlet coupled to the main flange, a combustion fuel inlet coupled to the main flange, a nozzle pipe coupled to the main flange, an outer pipe coupled to the main flange, the outer pipe being around the nozzle pipe, and a diffuser coupled to the nozzle pipe and the outer pipe. The nozzle pipe has an inner volume in fluid communication with the oxidant inlet. An annular volume is at least partially defined by the main flange, the nozzle pipe, the outer pipe, and the diffuser. The annular volume is in fluid communication with the combustion fuel inlet. The diffuser is flat. The nozzle pipe may comprise a first cylindrical section having a first diameter, a second cylindrical section having a second diameter larger than the first diameter, and a third frustoconical section between the first cylindrical section and the second cylindrical section. The first section may be proximate the oxidant inlet. The third frustoconical section may expand from the first diameter to the second diameter. The diffuser may comprise a first plurality of apertures in fluid communication with the inner volume of the nozzle pipe and a second plurality of apertures in fluid communication with the annular volume of the nozzle pipe.

The oxidant may comprise pure oxygen. The oxidant may consist essentially of pure oxygen. The combustion fuel may comprise pure hydrogen. The combustion fuel may consist essentially of pure hydrogen.

A combustion chamber may comprise the burner. The combustion chamber may further comprise an ignition source. The ignition source may comprise an igniter plug. The ignition source may be proximate the second plurality of apertures. The combustion chamber may comprise carbon steel. The carbon steel may be inhibited from rusting by the oxidant being radially inward of the combustion fuel.

In some embodiments, a method of operating a combustion chamber comprises starting an ignition source, flowing oxidant into the combustion chamber, and, after flowing the oxidant, flowing combustion fuel into the chamber.

The method may further comprise creating a vacuum in the combustion chamber before flowing the oxidant. The oxidant may comprise pure oxygen. The oxidant may consist essentially of pure oxygen. The combustion fuel may comprise pure hydrogen. The combustion fuel may consist essentially of pure hydrogen. The combustion chamber may comprise the burner.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and not to be considered limiting of its scope, the disclosure will be described with additional specificity and detail through use of the accompanying drawings. In the following Detailed Description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the drawings, may be arranged, substituted, combined, and/or designed in a wide variety of different configurations, all of which are explicitly contemplated and made part of this disclosure.

FIGS. 1Cii-1Cv are a cross sectional views of additional examples of burners.

DETAILED DESCRIPTION

The hydrogen combustion chambers disclosed herein may be used with any fuel source, including but not limited to, pure hydrogen, methane, ethane, propane, butane, and all the "XXXtanes." When the fuel source is pure hydrogen, and is not a carbon-based fuel, the combustion does not form sulfuric acid, nitric acid, carbonic acids, Polynuclear Aromatics (PNA's), and/or other hazardous air pollutants that can contribute to an acidic exhaust and a corrosive atmosphere found in certain fossil fuel and wood fired boilers.

Figure 1A:
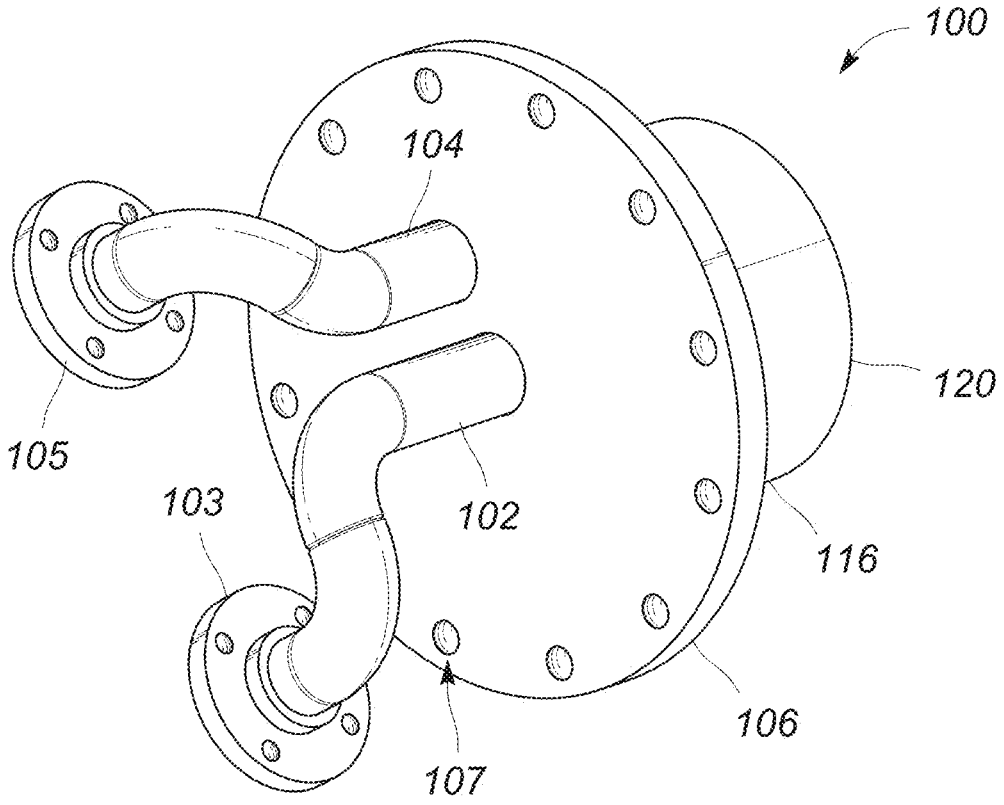
FIG. 1A is a back and side perspective view of an example burner.

FIG. 1A is a back and side perspective view of an example burner 100. The burner 100 comprises a first inlet 102. Preferably, the first inlet 102 is an oxidant inlet. For example, the oxidant may comprise air, oxygen enriched air, pure oxygen, and/or other oxidants. The burner 100 comprises second inlet 104. Preferably, the second inlet 104 is a combustion fuel inlet. For example, the combustion fuel may comprise pure hydrogen, a hydrocarbon, and/or other combustible fuels. The combustion of pure oxygen and pure hydrogen that may be provided by the burner 100 can advantageously reduce pollution, for example, by not producing carbon dioxide, carbon monoxide, or nitrogen oxides due to the absence of carbon and nitrogen during the combustion process. The first inlet 102 is optionally coupled to a first inlet flange 103. The second inlet 104 is optionally coupled to a second inlet flange 105. The first inlet flange 103 and/or the second inlet flange 105 may be a lap joint flange. The first inlet flange 103 and/or the second inlet flange 105 can allow the burner 100 to be coupled to gas sources, including, for example, manifolds or directly to gas supplies. Other piping and instrumentation to couple the inlets to other appropriate gas, liquid, and/or solid (e.g., powder, pulverized solid) sources are also possible. As used herein, the term coupled is a broad term that can include directly coupled or coupled via an intermediate element. The coupling can be permanent or temporary.

The burner 100 comprises a main flange 106. The main flange 106 can provide a coupling structure to link together other components of the burner 100. The first inlet 102 is coupled to the main flange 106. The second inlet 104 is coupled to the main flange 106. The main flange 106 can provide a coupling structure couple the burner 100 to a boiler, reactor, or other structure. For example, the main flange 106 can include apertures 107 through which bolts, rivets, etc. may be inserted.

The burner 100 comprises an outer pipe or tube 116. The outer pipe 116 is substantially cylindrical having a circular lateral cross-section. Other shapes are also possible, including but not limited to lateral cross-sections that are elliptical, polygonal, etc. and/or sidewalls that are not parallel to the longitudinal axis. For example, the outer pipe 116 may be frustoconical with a narrower diameter proximate the main flange 106 and a wider diameter proximate the diffuser 120. The outer pipe 116 may comprise one or more longitudinal grooves, for example for use in aligning components of the burner 100 and/or aligning the burner 100 with one or more other components of a combustion chamber.

Figure 1B:
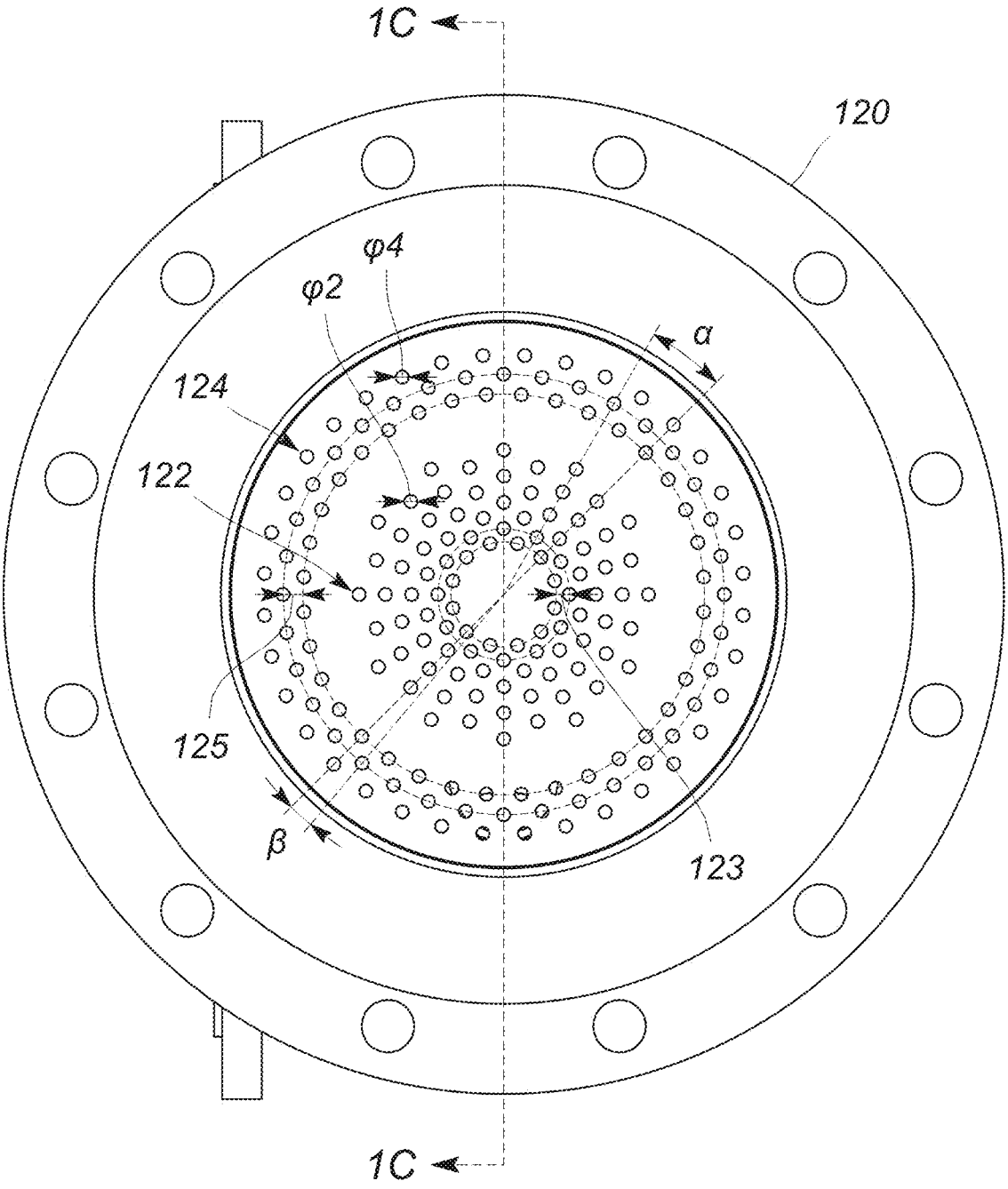
FIG. 1B is a front view of the burner of FIG. 1A.

FIG. 1B is a front view of the burner 100 of FIG. 1A. The front view primarily shows the diffuser 120. The diffuser 120 includes a first plurality of apertures 122 and a second plurality of apertures 124. The second plurality of apertures 124 is radially outward of the first plurality of apertures 122. The first plurality of apertures 122 provide an exit path for the oxidant (e.g., pure oxygen) flowing into the burner 100. The second plurality of apertures 124 provide an exit path for the combustion fuel (e.g., pure hydrogen) flowing into the burner 100. FIG. 1B shows one example of an arrangement of each of the first plurality of apertures 122 (e.g., series of four radially aligned apertures in which every other radius is radially offset) and the second plurality of apertures 124 (e.g., series of concentrically aligned apertures in which every other circumference is circumferentially offset). Other arrangements are also possible. For example, the first plurality of apertures 122 could include a series of concentrically aligned apertures in which every other circumference is circumferentially offset. For another example, the second plurality of apertures 124 could include a series of radially aligned apertures in which every other radius is radially offset. Other patterns are also possible. In some embodiments (e.g., comprising a relatively thin diffuser 120), the plurality of apertures 122, 124 may be laser-drilled. In some embodiments (e.g., comprising a relatively thick diffuser 120), the plurality of apertures 122, 124 may be machined.

Figure 1C:
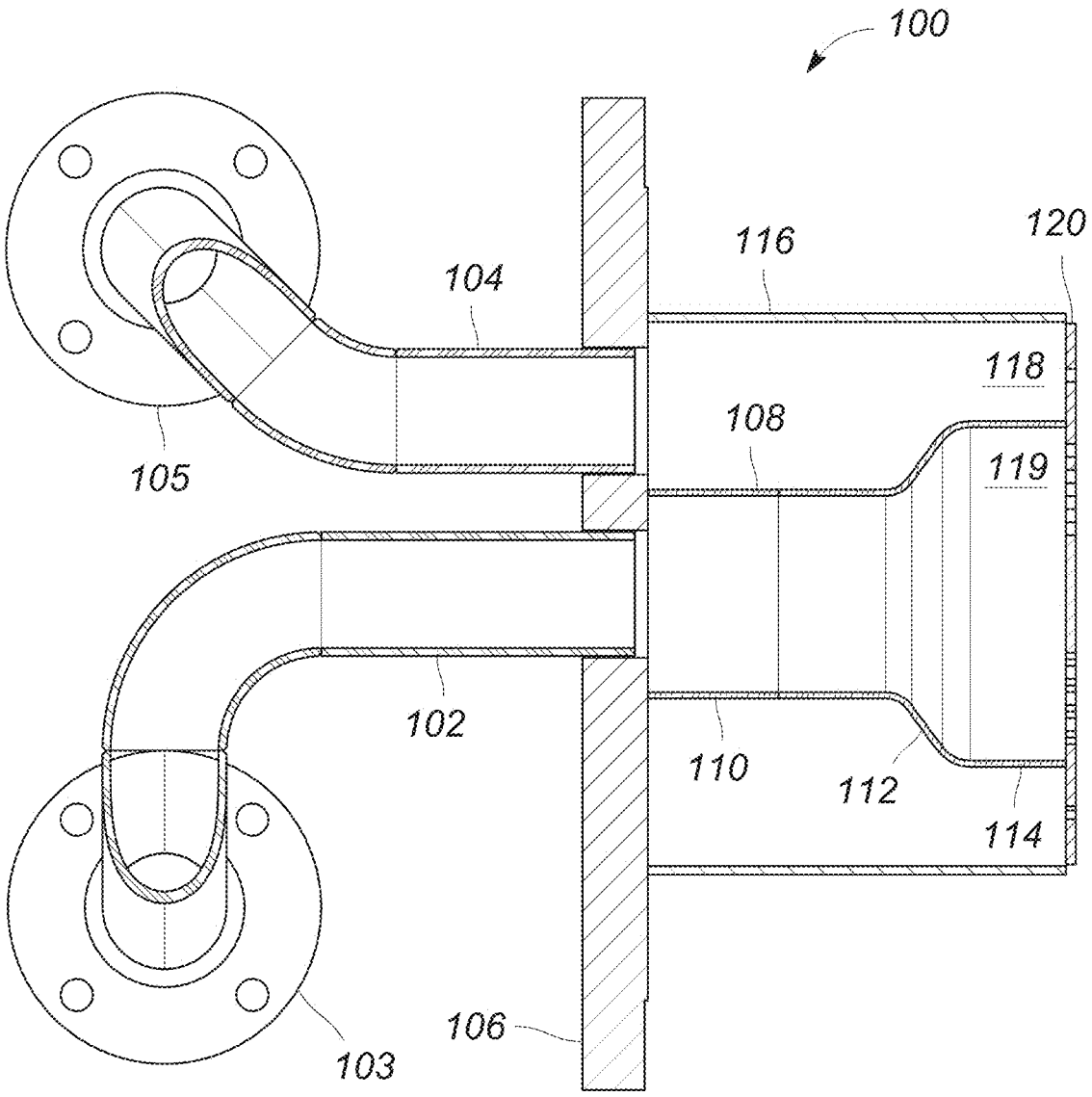
FIG. 1Ci is a cross sectional view of the burner of FIG. 1A along the line 1C-1C of FIG. 1B.
Figure 1C:
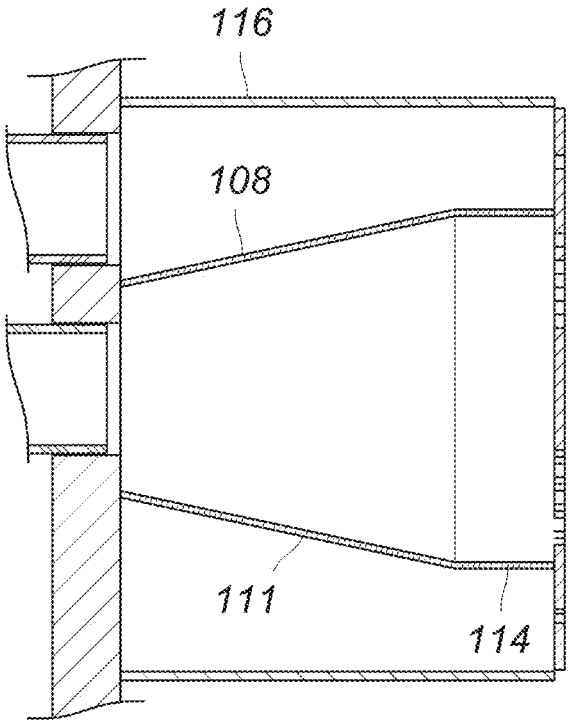
Figure 1C:
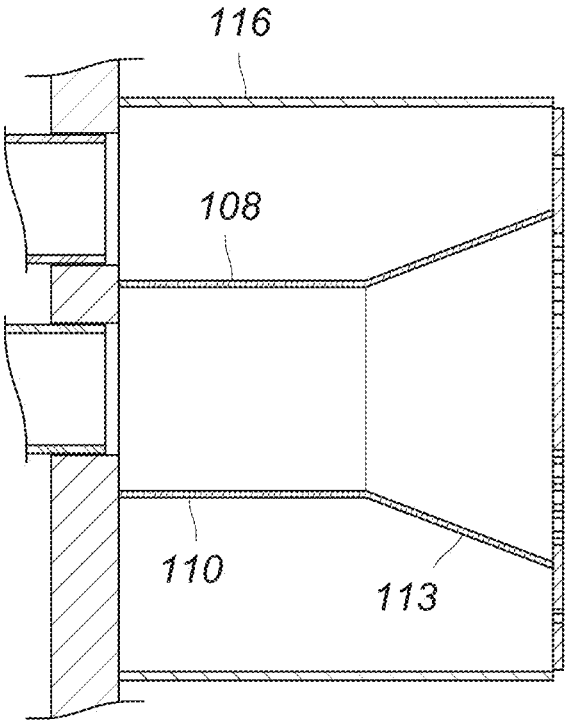
Figure 1C:
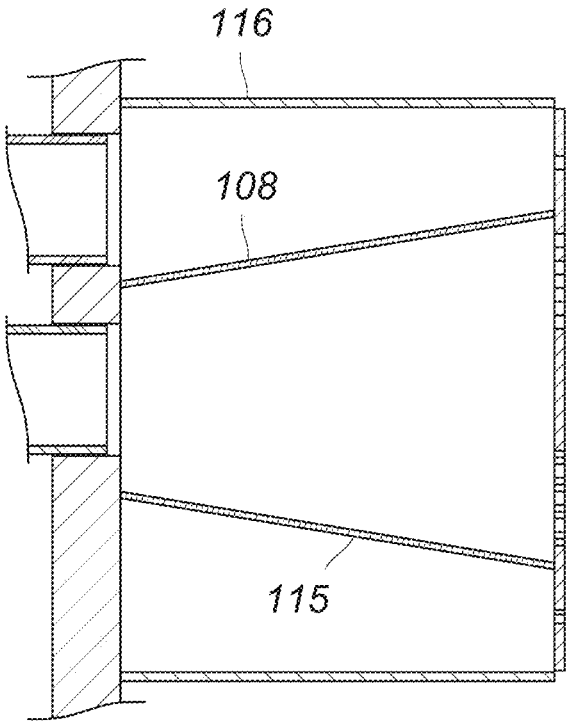
Figure 1C:
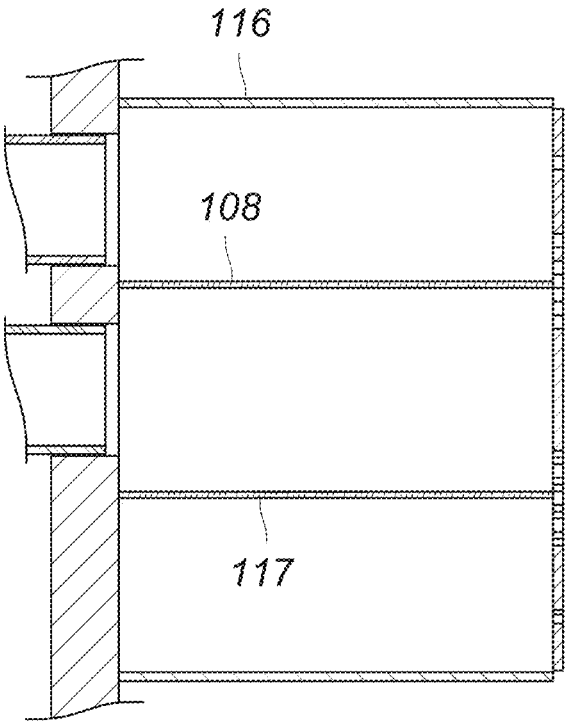

In some implementations, the first plurality of apertures 122 and/or the second plurality of apertures 124 may be straight (e.g., as illustrated in FIG. 1Ci). In some implementations, the first plurality of apertures 122 and/or the second plurality of apertures 124 may be angled. For example, the angles may be configured to create turbulence to increase mixing (e.g., if the oxidant is air such that NOx is a possibility). For another example, the angles may be configured to direct one or both of the gases towards a center of the burner 100. For another example, the angles may be configured to inhibit (e.g., prevent) laminar flow and/or a steam barrier between the oxygen and hydrogen inhibiting (e.g., preventing) the exothermic reaction from occurring sooner than later, resulting in longer flames, larger reaction box/fire box, and/or higher capital cost of construction.

Each aperture of the first plurality of apertures 122 may have the same diameter. For example, each aperture of the first plurality of apertures 122 illustrated in FIG. 1B has a diameter $\varphi_2$ of 0.25 inches (approx. 6.4 mm). In some embodiments, one or some of the apertures of the first plurality of apertures 122 could have a different diameter than one or some of the other apertures of the first plurality of apertures 122. In some embodiments, the apertures of the first plurality of apertures 122 have a diameter $\varphi_2$ between about 0.1 inches (approx. 2.5 mm) and about 1 inch (approx. 25.4 mm) (e.g., about 0.1 inches (approx. 2.5 mm), about 0.125 inches (approx. 3.2 mm), about 0.2 inches (approx. 5.1 mm), about 0.25 inches (approx. 6.4 mm), about 0.3 inches (approx. 7.6 mm), about 0.33 inches (approx. 8.4 mm), about 0.375 inches (approx. 9.5 mm), about 0.5 inches (approx. 12.7 mm), about 0.625 inches (approx. 15.9 mm), about 0.75 inches (approx. 19.1 mm), about 0.875 inches (approx. 22.2 mm), about 1 inch (approx. 25.4 mm), and ranges between such values). At least one or some of the apertures of the first plurality of apertures 122 may have a different diameter than at least one or some others of the apertures of the first plurality of apertures 122. In embodiments in which a solid is used, for example, the apertures of the first plurality of apertures 122 may have larger diameters.

Each aperture of the second plurality of apertures 124 may have the same diameter. For example, each aperture of the second plurality of apertures 124 illustrated in FIG. 1B has a diameter $\varphi_4$ of 0.25 inches (approx. 6.4 mm). In some embodiments, one or some of the apertures of the second plurality of apertures 124 could have a different diameter than one or some of the other apertures of the second plurality of apertures 124. In some embodiments, the apertures of the second plurality of apertures 124 have a diameter $\varphi_4$ between about 0.1 inches (approx. 2.5 mm) and about 1 inch (approx. 25.4 mm) (e.g., about 0.1 inches (approx. 2.5 mm), about 0.125 inches (approx. 3.2 mm), about 0.2 inches (approx. 5.1 mm), about 0.25 inches (approx. 6.4 mm), about 0.3 inches (approx. 7.6 mm), about 0.33 inches (approx. 8.4 mm), about 0.375 inches (approx. 9.5 mm), about 0.5 inches (approx. 12.7 mm), about 0.625 inches (approx. 15.9 mm), about 0.75 inches (approx. 19.1 mm), about 0.875 inches (approx. 22.2 mm), about 1 inch (approx. 25.4 mm), and ranges between such values). At least one or some of the apertures of the second plurality of apertures 124 may have a different diameter than at least one or some others of the apertures of the second plurality of apertures 124. In embodiments in which a solid is used, the apertures of the second plurality of apertures 124 may have larger diameters.

In some embodiments (e.g., as illustrated in FIG. 1B), each the apertures of the first plurality of apertures 122 has the same diameter as each of the apertures of the second plurality of apertures 124 ($\varphi_2=\varphi_4$). In some embodiments, each of the apertures of the first plurality of apertures 122 has a larger diameter than each of the apertures of the second plurality of apertures 124 ($\varphi_2>\varphi_4$). In some embodiments, each of the apertures of the first plurality of apertures 122 has a smaller diameter than each of the apertures of the second plurality of apertures 124 ($\varphi_2<\varphi_4$). In some embodiments, at least one of the apertures of the first plurality of apertures 122 is larger than at least one of the apertures of the second plurality of apertures 124. In some embodiments, at least one of the apertures of the second plurality of apertures 124 is larger than at least one of the apertures of the first plurality of apertures 122. The term diameter may be given its ordinary meaning of a straight line passing from side to side through the center of a body, which may include a circle, polygon, or other shape.

Each radial row of the first plurality of apertures 122 illustrated in FIG. 1B comprises 4 apertures. In some embodiments, the radial rows of the first plurality of apertures 122 comprise between 1 aperture and 10 apertures (e.g., 1 aperture, 2 apertures, 3 apertures, 4 apertures, 5 apertures, 6 apertures, 7 apertures, 8 apertures, 9 apertures, 10 apertures, and ranges between such values). In some embodiments, adjacent radial rows of the first plurality of apertures 122 have different quantities of apertures. For example, a radial row may have one fewer aperture than adjacent radial rows. In some embodiments, adjacent radial rows of the first plurality of apertures 122 have the same quantities of apertures (e.g., as illustrated in FIG. 1B).

Each radial row of the second plurality of apertures 124 illustrated in FIG. 1B comprises 1 aperture or 2 apertures, alternatingly. In some embodiments, the radial rows of the second plurality of apertures 124 comprise between 1 aperture and 10 apertures (e.g., 1 aperture, 2 apertures, 3 apertures, 4 apertures, 5 apertures, 6 apertures, 7 apertures, 8 apertures, 9 apertures, 10 apertures, and ranges between such values). In some embodiments, adjacent radial rows of the first plurality of apertures 124 have different quantities of apertures. For example, as illustrated in FIG. 1B, a radial row may have one fewer aperture than adjacent radial rows.

In some embodiments, adjacent radial rows of the first plurality of apertures 124 have the same quantities of apertures.

The radial rows of the first plurality of apertures 122 illustrated in FIG. 1B are circumferentially offset by an angle $\alpha$ of about 15°. In some embodiments, the radial rows of the first plurality of apertures 122 are radially offset by an angle $\alpha$ between about 5° and about 25° (e.g., about 5°, about 10°, about 15°, about 20°, about 25°, and ranges between such values).

The radial rows of the second plurality of apertures 124 illustrated in FIG. 1B are circumferentially offset by an angle $\beta$ of about 5°. In some embodiments, the radial rows of the second plurality of apertures 124 are radially offset by an angle $\beta$ between about 2° and about 15° (e.g., about 2°, about 3°, about 4°, about 5°, about 6°, about 7°, about 8°, about 9°, about 10°, about 15°, and ranges between such values).

In some embodiments, the angle $\alpha$ is greater than the angle $\beta$ (e.g., $\alpha=1.5\times\beta$, $\alpha=2\times\beta$, $\alpha=2.5\times\beta$, $\alpha=3\times\beta$ (e.g., as illustrated in FIG. 1B), $\alpha=3.5\times\beta$, $\alpha=4\times\beta$, $\alpha=5\times\beta$, and ranges between such values). In some embodiments, the angle $\alpha$ is the same as the angle $\beta$ (e.g., $\alpha=\beta$. In some embodiments, the angle $\alpha$ is less than the angle $\beta$ (e.g., $\alpha=0.67\times\beta$, $\alpha=0.5\times\beta$, $\alpha=0.4\times\beta$, $\alpha=0.33\times\beta$, $\alpha=0.29\times\beta$, $\alpha=0.25\times\beta$, $\alpha=0.2\times\beta$, and ranges between such values).

The centers of the apertures of adjacent radial rows of the first plurality of apertures 122 illustrated in FIG. 1B are spaced by a distance 123 of about 0.5 inches (approx. 12.7 mm). For example, if the inner-most apertures have a center that is about 2 inches (approx. 50.8 mm) from the center and each radial row comprises four apertures, the outer-most apertures may have a center that is about 5.5 inches (approx. 139.7 mm) from the center. In some embodiments, the centers of the apertures of adjacent radial rows of the first plurality of apertures 122 are spaced by a distance 123 between about 0.2 inches (approx. 5.1 mm) and about 2 inches (approx. 50.8 mm) (e.g., about 0.2 inches (approx. 5.1 mm), about 0.25 inches (approx. 6.4 mm), about 0.4 inches (approx. 10.1 mm), about 0.5 inches (approx. 12.7 mm), about 0.6 inches (approx. 15.2 mm), about 0.67 inches (approx. 17 mm), about 0.75 inches (approx. 19.1 mm), about 1 inch (approx. 25.4 mm), about 1.25 inches (approx. 31.8 mm), about 1.5 inches (approx. 38.1 mm), about 1.75 inches (approx. 44.4 mm), about 2 inches (approx. 50.8 mm), and ranges between such values). The centers of the apertures of adjacent radial rows of the first plurality of apertures 122 illustrated in FIG. 1B are spaced by a distance 123 of about 2× the diameter $\varphi_2$ of the apertures of the first plurality of apertures 122. In some embodiments, the centers of the apertures of adjacent radial rows of the first plurality of apertures 122 are spaced by a distance 123 between about $1\times\varphi_2$ and about $3\times\varphi_2$ (e.g., about $1\times\varphi_2$, about $1.5\times\varphi_2$, about $2\times\varphi_2$, about $2.5\times\varphi_2$, about $3\times\varphi_2$, and ranges between such values). In some embodiments, the centers of the apertures of adjacent radial rows of the first plurality of apertures 122 are spaced by a distance 123 that increases with distance from the center. In some embodiments, the centers of the apertures of adjacent radial rows of the first plurality of apertures 122 are spaced by a distance 123 that decreases with distance from the center.

The centers of the apertures of adjacent radial rows of the second plurality of apertures 124 illustrated in FIG. 1B are spaced by a distance 125 of about 0.75 inches (approx. 19.1 mm). For example, if the inner-most apertures have a center that is about 7.625 inches (approx. 193.7 mm) from the center and each radial row comprises two apertures or one aperture, the outer-most apertures may have a center that is about 9.125 inches (approx. 231.8 mm) from the center. In some embodiments, the centers of the apertures of adjacent radial rows of the second plurality of apertures 124 are spaced by a distance 125 between about 0.25 inches (approx. 6.4 mm) and about 3 inches (approx. 76.2 mm) (e.g., about 0.25 inches (approx. 6.4 mm), about 0.5 inches (approx. 12.7 mm), about 0.625 inches (approx. 15.9 mm), about 0.67 inches (approx. 17 mm), about 0.7 inches (approx. 17.8 mm), about 0.75 inches (approx. 19.1 mm), about 0.8 inches (approx. 20.3 mm), about 0.875 inches (approx. 22.2 mm), about 1 inch (approx. 25.4 mm), about 1.25 inches (approx. 31.8 mm), about 1.5 inches (approx. 38.1 mm), about 2 inches (approx. 50.8 mm), about 2.5 inches (approx. 63.5 mm), about 3 inches (approx. 76.2 mm), and ranges between such values). The centers of the apertures of adjacent radial rows of the second plurality of apertures 124 illustrated in FIG. 1B are spaced by a distance 125 of about 3× the diameter $\varphi_4$ of the apertures of the second plurality of apertures 124. In some embodiments, the centers of the apertures of adjacent radial rows of the second plurality of apertures 124 are spaced by a distance 125 between about $1\times\varphi_4$ and about $5\times\varphi_4$ (e.g., about $1\times\varphi_4$, about $2\times\varphi_4$, about $2.5\times\varphi_4$, about $3\times\varphi_4$, about $3.5\times\varphi_4$, about $4\times\varphi_4$, about $5\times\varphi_4$, and ranges between such values). In some embodiments, the centers of the apertures of adjacent radial rows of the second plurality of apertures 124 are spaced by a distance 125 that increases with distance from the center. In some embodiments, the centers of the apertures of adjacent radial rows of the second plurality of apertures 124 are spaced by a distance 125 that decreases with distance from the center.

Some or all of the apertures may have a circular lateral cross-section (e.g., as shown in FIG. 1B). Some or all of the apertures may have a different shape (e.g., elliptical, polygonal (e.g., triangular, rectangular, square, hexagonal, octagonal, etc.), straight and/or arcuate slits, etc.).

The diffuser 120 may comprise a detents or other extensions configured to interact with a longitudinal groove in the outer pipe 116, for example to align the diffuser 120 to the outer pipe 116 and/or one or more other components of a combustion chamber. The diffuser 120 is preferably flat, for example a flat plate, such that the first plurality of apertures 122 and the second plurality of apertures 124 are at a same longitudinal level, which may be vertical, horizontal, or angled depending on the arrangement in a combustion chamber. In some implementations, the diffuser 120 may be frustoconical. In some embodiments, the first plurality of apertures 122 may be distal to the second plurality of apertures 124. In some embodiments, the first plurality of apertures 122 may be proximal to the second plurality of apertures 124. The apertures of the first plurality of apertures 122 are preferably straight or non-angled or cylindrical. In some embodiments, the apertures of the first plurality of apertures 122 may diverge radially outward (e.g., towards the second plurality of apertures 124). The apertures of the second plurality of apertures 124 are preferably straight or cylindrical. In some embodiments, the apertures of the second plurality of apertures 124 may diverge radially inward (e.g., towards the first plurality of apertures 122). If the diffuser plate 120 did not include the first plurality of apertures 122 such that the oxidant could flow directly out of the burner 100, improper mixing, flow rates, etc. could occur.

In some embodiments, the first plurality of apertures 122 comprises between 50 and 150 apertures (e.g., 50, 75, 90, 96 (e.g., as illustrated in FIG. 1B), 100, 110, 125, 150, and ranges between such values). In some embodiments, the second plurality of apertures 124 comprises between 50 and 150 apertures (e.g., 50, 75, 95, 100, 108 (e.g., as illustrated in FIG. 1B), 115, 125, 150, and ranges between such values). A quantity of apertures of the first plurality of apertures 122 may be the same as a quantity of apertures of the second plurality of apertures 124. A quantity of apertures of the first plurality of apertures 122 may be greater than a quantity of apertures of the second plurality of apertures 124. A quantity of apertures of the first plurality of apertures 122 may be less than a quantity of apertures of the second plurality of apertures 124. In some embodiments, a quantity of apertures of the first plurality of apertures 122 may be within 5%, within 10%, or within 15% of a quantity of apertures of the second plurality of apertures 124.

FIG. 1Ci is a cross sectional view of the burner 100 of FIG. 1A along the line 1C-1C of FIG. 1B. Referring again to FIGS. 1A and 1B, the burner 100 comprises a first inlet 102, a second inlet 104, a main flange 106, an outer pipe 116, and a diffuser 120. FIG. 1Ci also shows that the burner 100 comprises a nozzle pipe 108. The nozzle pipe 108 is radially inward of the outer pipe 116. The volume 119 is inward of the inner wall of the nozzle pipe 108. The volume 119 is longitudinally between the main flange 106 and the diffuser 120. The oxidant flows into the burner 100 through the first inlet 102 and into a volume or space 119 at least partially defined by the nozzle pipe 108, the main flange 106, and the diffuser 120. The oxidant flows into the burner 100 through the first inlet 102 into the volume 119 and then out the first plurality of apertures 122 in the diffuser 120. The annular volume 118 is radially between the outer wall of the nozzle pipe 108 and the inner wall of the outer pipe 116. The annular volume 118 is longitudinally between the main flange 106 and the diffuser 120. The combustion fuel flows into the burner 100 through the second inlet 104 and into an annular volume or space 118 at least partially defined by the nozzle pipe 108, the outer pipe 116, the main flange 106, and the diffuser 120. The combustion fuel flows into the burner 100 through the second inlet 104 into the annular volume 118 and then out the second plurality of apertures 124 in the diffuser 120. The volumes 118, 119 are isolated in the burner such that the oxidant and the combustion fuel are inhibited or prevented from mixing until exiting the diffuser 120. The combustion fuel is not piped to each aperture of the second plurality of apertures 124 by a separate pipe, which can reduce construction and/or maintenance costs. In some embodiments, the burner 100 may comprise one or more baffles in the volume 118 (e.g., to help steer the combustion fuel in the volume 118). In some embodiments, the burner 100 may comprise one or more baffles in the volume 119 (e.g., to help steer the oxidant in the volume 119). In some embodiments, a reactor or combustion chamber may comprise baffles (e.g., to help steer the combustion fuel, the oxidant, a mixture thereof, and/or a product thereof). The baffles may comprise, for example, metal or refractory.

The nozzle pipe 108 shown in FIG. 1Ci includes a first cylindrical section 110, a second cylindrical section 114, and a third frustoconical section 112. The first cylindrical section 110 has a first diameter. The first cylindrical section 110 is proximate the oxidant inlet 102. The second cylindrical section has a second diameter larger than the first diameter. The second cylindrical section is proximate to the diffuser 120. The third frustoconical section 112 is longitudinally between the first cylindrical section 110 and the second cylindrical section 114. The third frustoconical section 112 expands from the first diameter to the second diameter. The nozzle pipe 108 has an expanding or diverging shape in which the nozzle pipe 108 is wider proximate to the outlet than the inlet, which can slow down the flow of the oxidant gas, allowing it to linger proximate to the burner and mix with the combustion fuel for more complete combustion. This shape can allow for physical constraints to access into the reaction box. Burners having a converging shape may disadvantageously increase a speed of the flow of the gas flowing through the converging shape such that the gas may quickly travel distal to the burner without mixing with the other gas.

In some embodiments, the first cylindrical section 110 has a first inner diameter between about 2 inches and about 6 inches (e.g., about 2 inches, about 2.5 inches, about 3 inches, about 3.5 inches, about 4 inches, about 4.5 inches, about 5 inches, about 5.5 inches, about 6 inches, and ranges between such values). Smaller and larger first inner diameters are also possible. In some embodiments, the first cylindrical section 110 has a length between about 3 inches and about 7 inches (e.g., about 3 inches, about 3.5 inches, about 4 inches, about 4.5 inches, about 5 inches, about 5.5 inches, about 6 inches, about 6.5 inches, about 7 inches, and ranges between such values). Smaller and larger lengths are also possible.

In some embodiments, the second cylindrical section 114 has a second inner diameter between about 4 inches and about 8 inches (e.g., about 4 inches, about 4.5 inches, about 5 inches, about 5.5 inches, about 6 inches, about 6.5 inches, about 7 inches, about 7.5 inches, about 8 inches, and ranges between such values). Smaller and larger second inner diameters are also possible. In some embodiments, the second cylindrical section 114 has a length between about 1 inch and about 5 inches (e.g., about 1 inch, about 1.5 inches, about 2 inches, about 2.5 inches, about 3 inches, about 3.5 inches, about 4 inches, about 4.5 inches, about 5 inches, and ranges between such values). Smaller and larger lengths are also possible.

In some embodiments, the third frustoconical section 112 has a taper angle between about 45° and about 75° (e.g., about 45°, about 50°, about 55°, about 60°, about 65°, about 70°, about 75°, and ranges between such values). Smaller and larger taper angles are also possible. In some embodiments, the third frustoconical section 112 has a length between about 1 inch and about 5 inches (e.g., about 1 inch, about 1.5 inches, about 2 inches, about 2.5 inches, about 3 inches, about 3.5 inches, about 4 inches, about 4.5 inches, about 5 inches, and ranges between such values). Smaller and larger lengths are also possible.

In some embodiments, the outer pipe 116 has an inner diameter between about 8 inches and about 12 inches (e.g., about 8 inches, about 8.5 inches, about 9 inches, about 9.5 inches, about 10 inches, about 10.5 inches, about 11 inches, about 11.5 inches, about 12 inches, and ranges between such values). Smaller and larger inner diameters are also possible. In some embodiments, the outer pipe 116 has a length between about 6 inches and about 10 inches (e.g., about 6 inches, about 6.5 inches, about 7 inches, about 7.5 inches, about 8 inches, about 8.5 inches, about 9 inches, about 9.5 inches, about 10 inches, and ranges between such values). Smaller and larger lengths are also possible.

In some embodiments, a ratio between the first inner diameter of the first cylindrical section 110 and the second inner diameter of the second cylindrical section 112 is between about 1:10 and about 9:10 (e.g., about 1:10, about 2:10, about 3:10, about 4:10, about 5:10, about 6:10, about 7:10, about 8:10, about 9:10, and ranges between such values). In some embodiments, a ratio between the first inner diameter of the first cylindrical section 110 and the inner diameter of the outer tube 116 is between about 2:10 and about 7:10 (e.g., about 2:10, about 3:10, about 4:10, about 5:10, about 6:10, about 7:10, and ranges between such values). In some embodiments, a ratio between the second inner diameter of the second cylindrical section 112 and the inner diameter of the outer tube 116 is between about 3:10 and about 8:10 (e.g., about 3:10, about 4:10, about 5:10, about 6:10, about 7:10, about 8:10, and ranges between such values).

In some embodiments, a ratio between the length of the first cylindrical section 110 and the length of the second cylindrical section 114 is between about 1:1 and about 5:1 (e.g., about 1:1, about 2:1, about 3:1, about 4:1, about 5:1, and ranges between such values). In some embodiments, a ratio between the length of the first cylindrical section 110 and the length of the outer tube 116 is between about 2:10 and about 8:10 (e.g., about 2:10, about 3:10, about 4:10, about 5:10, about 6:10, about 7:10 inches, about 8:10, and ranges between such values). In some embodiments, a ratio between the length of the second cylindrical section 114 and the length of the outer tube 116 is between about 1:10 and about 6:10 (e.g., about 1:10, about 2:10, about 3:10, about 4:10, about 5:10, about 6:10, and ranges between such values).

FIGS. 1Cii-1Cv are a cross sectional views of additional examples of burners. The burners in FIGS. 1Cii-1Cv share features with the burner 100, but have a differently-shaped nozzle pipe 108. In FIG. 1Cii, the nozzle pipe 108 comprises a first frustoconical section 111 and the second cylindrical section 114 having a second diameter and distal to the first frustoconical section 111. The first frustoconical section 111 expands from a first diameter to the second diameter larger than the first diameter. In FIG. 1Ciii, the nozzle pipe 108 comprises the first cylindrical section 110 having a first diameter and a second frustoconical section 113 distal to the first cylindrical section 110. The second frustoconical section 113 expands from the first diameter to a second diameter larger than the first diameter. In FIG. 1Civ, the nozzle pipe 108 comprises a frustoconical section 115 that expands from a first diameter to a second diameter larger than the first diameter. The nozzle pipe 108 in FIGS. 1Cii-1Civ still has a diverging shape. In FIG. 1Cv, the nozzle pipe 108 comprises one cylindrical section 117 having a substantially constant diameter. The relative longitudinal lengths of the various sections 110, 111, 112, 113, 114, 115, 117 of the nozzle pipe 108 may vary.

In some embodiments, the burner 100 lacks or is free of or does not include any additional gas flow pathways. For example, the burner 100 may lack an additional oxidant flow radially outward of the combustion fuel flow. For another example, the burner 100 may lack additional combustion fuel flows. For another example, the burner 100 may lack a biasing gas flow. Reducing the flow pathways can reduce construction and/or maintenance costs. A complicated manifold needed for additional and/or more complicated gas flow pathways would, by contrast, greatly increase costs.

Figure 1D:
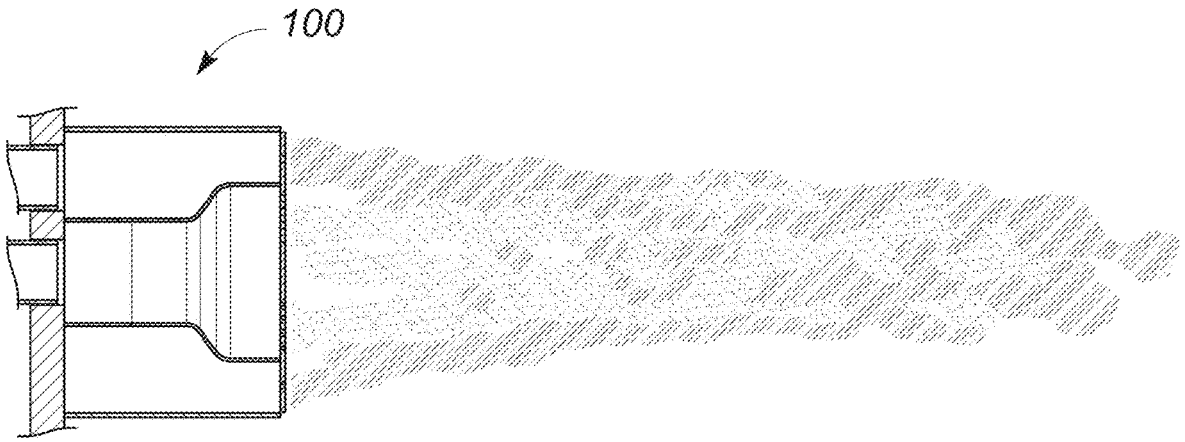
FIG. 1D is a schematic illustration of fluids flowing through the burner of FIG. 1A.

FIG. 1D is a schematic illustration of fluids flowing through the burner 100. In some embodiments, a ratio of the hydrogen velocity out of the burner 100 to the oxygen velocity out of the burner 100 is between about 1:10 and about 1:3 (e.g., about 1:10, about 1:9, about 1:8, about 1:7, about 1:6, about 1:5, about 1:4, about 1:3, and ranges between such values). The applicant has found that the hydrogen gas will fold inward into the center of the flame upon ignition, as shown in FIG. 1D. Different fluid flow rates can result in different profiles (e.g., flame lengths, taper angles, etc.). Although there is no intention to be bound by any particular theory presented herein, the folding is believed to be due to the affinity of the reactants wanting to combine and form the products of combustion (water and heat) while resulting in a cooler peripheral section of the flame near the diffuser 120. The final result is a more controlled and concentrated flame.

Figure 2:
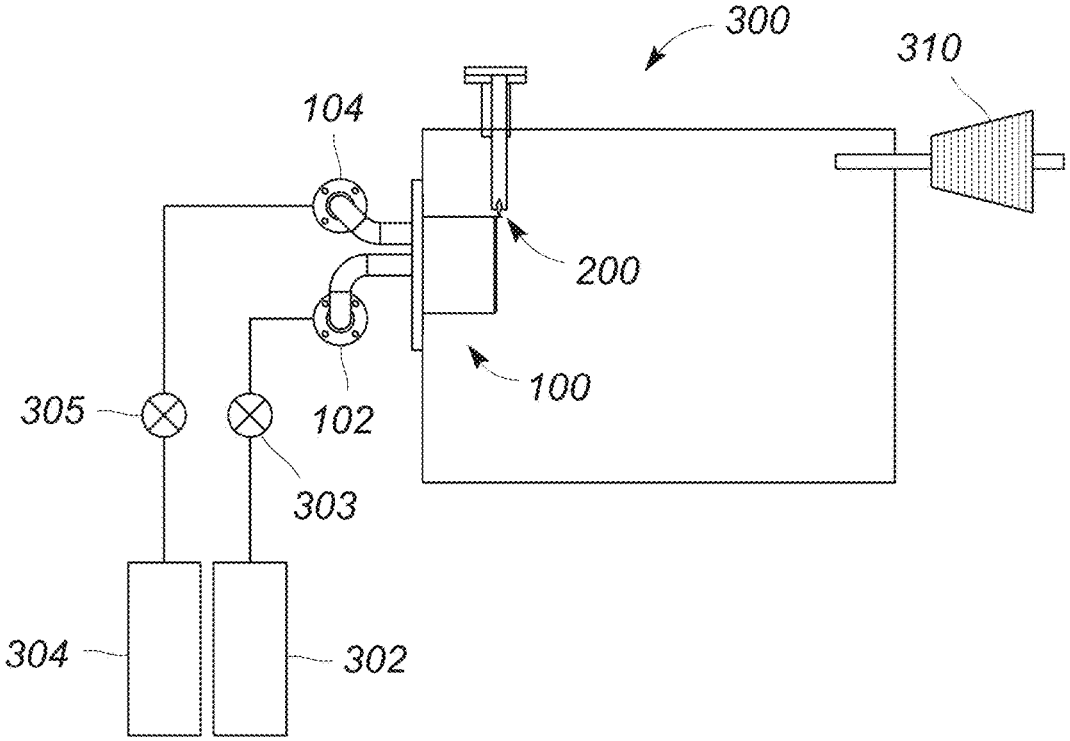
FIG. 2 is a schematic view of an example combustion chamber including the burner of FIG. 1A.

FIG. 2 is a schematic view of an example combustion chamber 300 including the burner 100 of FIG. 1A. The inlet 102 is in fluid communication with an oxidant source 302. A valve 303 between the oxidant source 302 and the inlet 102 can control an amount of the oxidant flowing into the burner 100. The inlet 104 is in fluid communication with a combustion fuel source 304. A valve 305 between the combustion fuel source 304 and the inlet 104 can control the amount of combustion fuel flowing into the burner 100. The combustion chamber 300 can share other features with the chambers described, for example, in U.S. Pat. No. 7,546,732, which is incorporated herein by reference in its entirety for all purposes. Certain features from those chambers are also possible, including additions, subtractions, and/or substitutions. The combustion chamber 300 shown in FIG. 3 comprises a steam turbine 310. In some embodiments, the steam turbine 310 may be configured to generate electricity from the steam produced by the combustion of hydrogen and oxygen. Other features are also possible. For example, the combustion chamber may comprise heat exchange tubes that exchange the heat from the produced steam with water in the combustion chamber 300 to turn that water into steam, which could be used to generate electricity.

FIG. 2 also shows an ignition source 200. The ignition source 200 may comprise any device configured to provide a source of ignition including, for example, but not limited to, spark plugs, igniter plugs (e.g., for jet engines, for rockets, for gas turbines, such as available from NGK Spark Plug Co., Ltd. of Nagoya, Japan), mechanically produced sparks, static electricity, electromagnetic waves, optical radiation, ultrasound, chemical reaction, combinations thereof, and/or the like. The ignition source 200 is preferably not positioned in the oxidant path and/or where the flame will occur. For example, the oxidant could oxidize the ignition source. For another example, the flame could melt the ignition source 200. The ignition source 200 is shown in FIG. 2 as being positioned proximate the outlet of the burner 100 in the combustion fuel flow. The combustion fuel can help to cool the ignition source 200. The combustion fuel can inhibit or prevent the oxidant from accessing the ignition source.

In some embodiments, a method of operating the combustion chamber 300 comprises producing a vacuum in the combustion chamber 300. The ignition source 200 is ignited (e.g., by providing a current to an igniter plug). The valve 303 is opened to allow oxidant to flow into the chamber 300 through the burner 100. In some embodiments, the maximum oxidant flow may be between about 150,000 cubic feet per hour (cfh) (approx. 71,000 liters per minute (Lpm)) and about 250,000 cfh (approx. 118,000 Lpm) (e.g., about 150,000 cfh (approx. 71,000 Lpm), about 175,000 cfh (approx. 83,000 Lpm), about 200,000 cfh (approx. 94,000 Lpm), about 225,000 cfh (approx. 106,000 Lpm), about 250,000 cfh (approx. 118,000 Lpm), ranges between such values, and the like) delivery or between about 0.5 pounds per second per cubic foot (lbscf) (approx. 8 grams per second per liter (gsL)) and about 1.5 lbscf (approx. 24 gsL) (e.g., about 0.5 lbscf (approx. 8 gsL), about 0.75 lbscf (approx. 12 gsL), about 1 lbscf (approx. 16 gsL), about 1.25 lbscf (approx. 20 gsL), about 1.5 lbscf (approx. 24 gsL), ranges between such values, and the like). As described herein, the oxidant flowing through the burner 100 includes entering the burner 100 through the inlet 102, traversing the nozzle pipe 108, and exiting the first plurality of apertures 122 of the diffuser 120. The oxidant can build some pressure in the chamber 300. In some embodiments, the oxidant may be deployed at a pressure between about 250 kiloPascals (kPa) (approx. 36 pounds per square inch (psi)) and about 350 kPa (approx. 51 psi) (e.g., about 250 kPa (approx. 36 psi), about 275 kPa (approx. 40 psi), about 300 kPa (approx. 44 psi), about 325 kPa (approx. 47 psi), about 350 kPa (approx. 51 psi), ranges between such values, and the like). No reaction takes place in the chamber 300 because the oxidant has nothing with which to react. The valve 305 can then be opened to allow combustion fuel to flow into the chamber 300 through the burner 100. In some embodiments, the maximum combustion fuel flow may be between about 20,000 cfh (approx. 9,500 Lpm) and about 30,000 cfh (approx. 14,000 Lpm) (e.g., about 20,000 cfh (approx. 9,500 Lpm), about 22,500 cfh (approx. 10,600 Lpm), about 25,000 cfh (approx. 17,800 Lpm), about 27,500 cfh (approx. 13,000 Lpm), about 30,000 cfh (approx. 14,000 Lpm), ranges between such values, and the like) delivery or between about 0.075 lbscf (approx. 1.2 gsL) and about 0.175 lbscf (approx. 2.8 gsL) (e.g., about 0.075 lbscf (approx. 1.2 gsL), about 0.1 lbscf (approx. 1.6 gsL), about 0.125 lbscf (approx. 2 gsL), about 0.15 lbscf (approx. 2.4 gsL), about 0.175 lbscf (approx. 2.8 gsL), ranges between such values, and the like). As described herein, the combustion fuel flowing through the burner 100 includes entering the burner 100 through the inlet 104, traversing the annular volume 118, and exiting the second plurality of apertures 124 of the diffuser 120. In some embodiments, a force of the trajectory of the oxidant exiting the first plurality of apertures 122 may be greater than a force of the trajectory of the combustion fuel exiting the second plurality of apertures 124. The chamber 300 already includes an excess of oxidant and an active ignition source 200, so the combustion fuel and the oxidant substantially immediately react. The mass-to-mass ratio of the oxidant and the combustion fuel may be 8:1. In some embodiments, the combustion fuel can flow after flowing the oxidant for some amount of time. The amount of time can be as low as, for example, 0.25 seconds.

The oxidant (e.g., pure oxygen) preferably flows through the nozzle pipe 108 and the combustion fuel (e.g., pure hydrogen) preferable flows around the nozzle pipe 108 such that the combustion fuel is radially outside the oxidant, which can provide one, some, or all of several advantages. For example, if the oxidant is radially outside, the oxidant could oxidize or corrode the walls of the chamber 300. Hematite or magnetite formation from oxidation and/or the proximity of oxygen to high heat conditions can migrate from the combustion chamber 300 to other parts of the reactor. The combustion fuel being radially outside the oxidant can inhibit or prevent oxidation of the walls of the chamber 300 and/or other parts of the reactor. Inhibiting or preventing oxidation can make possible less expensive reactors, for example in which the chamber 300 comprises carbon steel and/or stainless steel comprising low chromium content. Inhibiting or preventing oxidation can make downstream components more reliable, such as reducing or preventing fouling of downstream oxidizer membranes with rust or hematite particles. For another example, the oxidant generally defines the locus of the combustion reaction (e.g., due to the folding action described herein), so the oxidant being radially inside the combustion fuel can help to space the flame and resulting heat from the walls of the chamber 300. For another example, the combustion fuel being radially outside can lubricate and/or cool the walls of the chamber 300. This may serve an advantage of reducing (e.g., preventing) hematite formation (red rust) on the walls of the combustion chamber 300.

The Applicant has found liquid water condensed on a viewing window into the chamber 300 that is inches away from the flame. The heat from the reaction would have been thought to be so intense that liquid water would not occur in proximity to the flame. However, the existence of liquid water in proximity to the flame can be indicative that the reaction produces little radiant heat because the reaction is in the ultraviolet range (e.g., as opposed to the infrared range). In some embodiments, a method comprises observation of water on a viewing window into the chamber 300 to confirm desired combustion.

The chamber 300 and/or an alternative chamber may comprise multiple burners 100. For example, each burner 100 can be in communication with one plurality of heat exchange coils. All of the heat exchange coils may be in contact with a common pool of water. One, some, or all of the pluralities of heat exchange coils may be in contact with a different pool of water.

Certain groups of figures showing similar items follow a numbering convention in which the first digit or digits correspond to the drawing figure number and the remaining digits identify an element or component in the drawing. Similar elements or components between such groups of figures may be identified by the use of similar digits. For example, 120 may reference element "20" in FIG. 1A, and a similar element "20" may be referenced as 220 in FIG. 2. As will be appreciated, elements shown in the various examples herein can be added, exchanged, and/or eliminated so as to provide any number of additional examples of the present disclosure. Components or features described in connection with a previous figure may not be described in detail in connection with subsequent figures; however, the examples illustrated in the subsequent figures may include any of the components or combinations of components or features of the previous examples.

Various modifications to the embodiments described in this disclosure will be readily apparent to those skilled in the art, and the generic principles defined herein may be applied to other embodiments without departing from the spirit or scope of this disclosure. Thus, the disclosure is not intended to be limited to the embodiments discussed herein but is to be accorded the widest scope consistent with the claims, the principles and the novel features disclosed herein. The word "example" is used exclusively herein to mean "serving as an example, instance, or illustration." Any embodiment described herein as "example" is not necessarily to be construed as preferred or advantageous over other embodiments, unless otherwise stated.

The foregoing description and examples has been set forth merely to illustrate the disclosure and are not intended as being limiting. Each of the disclosed aspects and examples of the present disclosure may be considered individually or in combination with other aspects, examples, and variations of the disclosure. In addition, unless otherwise specified, none of the steps of the methods of the present disclosure are confined to any particular order of performance. Modifications of the disclosed examples incorporating the spirit and substance of the disclosure may occur to persons skilled in the art and such modifications are within the scope of the present disclosure. Furthermore, all references cited herein are incorporated by reference in their entirety.

Certain features that are described in this specification in the context of separate embodiments also may be embodied in combination in a single embodiment. Conversely, various features that are described in the context of a single embodiment also may be embodied in multiple embodiments separately or in any suitable sub-combination. Moreover, although features may be described above as acting in certain combinations and even initially claimed as such, one or more features from a claimed combination may in some cases be excised from the combination, and the claimed combination may be directed to a sub-combination or variation of a sub-combination.

Similarly, while operations are depicted in the drawings in a particular order, this should not be understood as requiring that such operations be performed in the order shown or in sequential order, or that all illustrated operations be performed, to achieve desirable results. Additionally, other embodiments are within the scope of the following claims. In some cases, the actions recited in the claims may be performed in a different order and still achieve desirable results.

While the methods and devices described herein may be susceptible to various modifications and alternative forms, specific examples thereof have been shown in the drawings and are herein described in detail. It should be understood, however, that the invention is not to be limited to the particular forms or methods disclosed, but, to the contrary, the invention is to cover all modifications, equivalents, and alternatives falling within the spirit and scope of the various examples described and the appended claims. Further, the disclosure herein of any particular feature, aspect, method, property, characteristic, quality, attribute, element, or the like in connection with an example can be used in all other examples set forth herein. Any methods disclosed herein need not be performed in the order recited. Depending on the example, one or more acts, events, or functions can be performed in a different sequence, can be added, merged (e.g., performed at least partially concurrently), or omitted altogether. Additionally, all possible combinations, subcombinations, and rearrangements of systems, methods, features, elements, modules, blocks, and so forth are within the scope of this disclosure. The use of sequential, or time-ordered language, such as "then," "next," "after," "subsequently," and the like, unless specifically stated otherwise, or otherwise understood within the context as used, is generally intended to facilitate the flow of the text and is not intended to limit the sequence of operations performed. Thus, some examples may be performed using the sequence of operations described herein, while other examples may be performed following a different sequence of operations.

Conditional language used herein, such as, among others, "can," "might," "may," "e.g.," and the like, unless specifically stated otherwise, or otherwise understood within the context as used, is generally intended to convey that some examples include, while other examples do not include, certain features, elements, and/or states. Thus, such conditional language is not generally intended to imply that features, elements, blocks, and/or states are in any way required for one or more examples or that one or more examples necessarily include logic for deciding, with or without author input or prompting, whether these features, elements and/or states are included or are to be performed in any particular example.

The methods disclosed herein may include certain actions taken by a practitioner; however, the methods can also include any third-party instruction of those actions, either expressly or by implication. For example, actions such as "flowing hydrogen" include "instructing flowing hydrogen."

The ranges disclosed herein also encompass any and all overlap, sub-ranges, and combinations thereof. Language such as "up to," "at least," "greater than," "less than," "between," and the like includes the number recited. Numbers preceded by a term such as "about" or "approximately" include the recited numbers and should be interpreted based on the circumstances (e.g., as accurate as reasonably possible under the circumstances, for example ±5%, ±10%, ±15%, etc.). For example, "about 10 mm" includes "10 mm." Phrases preceded by a term such as "substantially" include the recited phrase and should be interpreted based on the circumstances (e.g., as much as reasonably possible under the circumstances). For example, "substantially perpendicular" includes "perpendicular." Unless stated otherwise, all measurements are at standard conditions including temperature and pressure. The phrase "at least one of" is intended to require at least one item from the subsequent listing, not one type of each item from each item in the subsequent listing. For example, "at least one of A, B, and C" can include A, B, C, A and B, A and C, B and C, or A, B, and C.

What is claimed is:

1. A burner comprising:

a main flange;

an oxidant inlet coupled to the main flange;

a combustion fuel inlet coupled to the main flange;

a nozzle pipe coupled to the main flange, the nozzle pipe having an inner volume in fluid communication with the oxidant inlet, the nozzle pipe including:

a first cylindrical section having a first diameter, the first section proximate the oxidant inlet;

a second cylindrical section having a second diameter larger than the first diameter; and a third frustoconical section between the first cylindrical section and the second cylindrical section, the third frustoconical section expanding from the first diameter to the second diameter;

an outer pipe coupled to the main flange, the outer pipe being around the nozzle pipe;

a diffuser face coupled to the nozzle pipe and the outer pipe; and an annular volume located between the nozzle pipe and the outer pipe, wherein the annular volume is defined by the main flange, the nozzle pipe, the outer pipe, and the diffuser face and is in fluid communication with the combustion fuel inlet, the diffuser face being flat and including:

a first plurality of apertures in fluid communication with the inner volume of the nozzle pipe; and a second plurality of apertures in fluid communication with the annular volume of the nozzle pipe.

2. The burner of claim 1, wherein the oxidant comprises pure oxygen, and wherein the combustion fuel comprises pure hydrogen.

3. A combustion chamber comprising the burner of claim 1.

4. The combustion chamber of claim 3, further comprising an ignition source proximate the second plurality of apertures.

5. The combustion chamber of claim 3, wherein the combustion chamber comprises carbon steel, the carbon steel inhibited from rusting by the oxidant being radially inward of the combustion fuel.

6. A burner comprising:

a first plate;

a second plate, wherein the second plate is distal to the first plate in a direction of a flow of a combustion fuel;

an oxidant inlet;

a combustion fuel inlet;

an inner pipe coupled to the first plate;

an outer pipe coupled to the first plate, the outer pipe being around the inner pipe; and an annular volume located between the inner pipe and the outer pipe;

wherein:

the annular volume is at least partially defined by the first plate, the inner pipe, the outer pipe, and the second plate;

the annular volume is in fluid communication with the combustion fuel inlet and is configured to be filled with combustion fuel and to prevent oxidant from entering the annular volume; and the second plate is flat.

7. The burner of claim 6, wherein the inner pipe comprises:

a first cylindrical section having a first diameter, the first section proximate the oxidant inlet;

a second cylindrical section having a second diameter larger than the first diameter; and a third frustoconical section between the first cylindrical section and the second cylindrical section, the third frustoconical section expanding from the first diameter to the second diameter.

8. The burner of claim 6, wherein the oxidant comprises pure oxygen.

9. The burner of claim 6, wherein the combustion fuel comprises pure hydrogen.

10. A combustion chamber comprising the burner of claim 6.

11. The combustion chamber of claim 10, further comprising an ignition source.

12. The combustion chamber of claim 10, wherein the ignition source comprises an igniter plug.

13. The combustion chamber of claim 10, wherein the ignition source is proximate the second plate.

14. The combustion chamber of claim 10, wherein the combustion chamber comprises carbon steel, the carbon steel inhibited from rusting by the oxidant being radially inward of the combustion fuel.

15. A method of operating the combustion chamber of claim 10, the method comprising:

starting an ignition source;

flowing oxidant into the combustion chamber; and after flowing the oxidant, flowing combustion fuel into the combustion chamber.

16. The method of claim 15, further comprising creating a vacuum in the combustion chamber before flowing the oxidant.

17. The method of claim 15, wherein the oxidant comprises pure oxygen.

18. The method of claim 15, wherein the combustion fuel comprises pure hydrogen.

19. A burner comprising:

a first plate;

an oxidant inlet;

a combustion fuel inlet;

an inner pipe coupled to the first plate;

an outer pipe coupled to the first plate, the outer pipe being around the inner pipe, the outer pipe comprising a portion that has a frustoconical shape, a narrower diameter portion and a wider diameter portion; and an annular volume at least partially defined by at least the first plate, the inner pipe, and the outer pipe;

wherein the annular volume is located between the inner pipe and the outer pipe and is in fluid communication with the combustion fuel inlet.

20. The burner of claim 19, wherein the oxidant comprises pure oxygen.

21. The burner of claim 19, wherein the combustion fuel comprises pure hydrogen.

22. The burner of claim 19, comprising a second plate, wherein the second plate is distal to the first plate in a direction of a flow of a combustion fuel and wherein the annular volume is at least partially defined by at least the first plate, the inner pipe, the outer pipe, and the second plate.

23. A combustion chamber comprising the burner of claim 19, wherein the combustion chamber further comprises an ignition source comprising an igniter plug.

24. The combustion chamber of claim 23, wherein the ignition source comprises an igniter plug.

25. The combustion chamber of claim 23, wherein the burner comprises a second plate and the ignition source is proximate the second plate.

* * * * *